US006079057A

United States Patent [19]

Mette

[11] Patent Number: 6,079,057

[45] Date of Patent: Jun. 27, 2000

[54] ADJUSTABLE URINAL

[76] Inventor: Philip Michael Mette, 9404 Honey Road, RR. #1, Bailieboro, Canada, KOL 1BO

[21] Appl. No.: 09/293,300

[22] Filed: Apr. 16, 1999

Related U.S. Application Data

[63] Continuation-in-part of application No. 08/888,070, Jul. 3, 1997, abandoned.

[30] Foreign Application Priority Data

Jul. 4, 1996 [GB] United Kingdom ..... 9614056
Mar. 5, 1997 [CA] Canada ..... 2199188

[51] Int. Cl.[7] ..... E03D 1/22
[52] U.S. Cl. ..... 4/342
[58] Field of Search ..... 4/340–342, 307, 4/144.1

[56] References Cited

U.S. PATENT DOCUMENTS

| | | | |
|---|---|---|---|
| 1,660,260 | 2/1928 | Diago | 4/307 |
| 4,137,579 | 2/1979 | Soler . | |
| 4,282,611 | 8/1981 | O'Day . | |
| 4,549,321 | 10/1985 | Douillard . | |
| 4,683,598 | 8/1987 | Jones . | |
| 4,982,455 | 1/1991 | Carter | 4/307 |
| 5,153,947 | 10/1992 | Markles . | |
| 5,285,532 | 2/1994 | Sealy | 4/144.1 X |
| 5,299,328 | 4/1994 | Walega . | |
| 5,390,374 | 2/1995 | Hubrig et al. . | |
| 5,575,020 | 11/1996 | Hubris et al. | 4/342 |
| 5,655,230 | 8/1997 | Corbin . | |

*Primary Examiner*—Charles E. Phillips
*Attorney, Agent, or Firm*—Huntley & Associates

[57] ABSTRACT

A urinal for use by persons of either sex. The urinal has a receptacle member and a tube, the receptacle member being pivotally mounted and movable between a variable first position and a second position. The receptacle member is usable by a person for the voiding of waste liquids therein when the receptacle member is in the first position. A tube is located within the receptacle member and adapted to be connected to a supply of water. The tube provides continuous flushing of the receptacle member with water when the receptacle member is in the first position. The receptacle member is connected to a drain for disposal of the waste liquids and water.

18 Claims, 5 Drawing Sheets

ADJUSTABLE URINAL

RELATED APPLICATION

This application is a continuation-in-part application of U.S. Ser. No. 08/888,070, filed Jul. 3, 1997 now abandoned.

FIELD OF THE INVENTION

The present invention relates to an adjustable urinal, and especially to a self-flushing adjustable urinal that is unisexual in nature i.e. may be used by either males or females. The adjustable urinal may be a stand alone unit or it may be associated with a conventional toilet. The position of the urinal in use may be as low as the floor, for use by children.

BACKGROUND TO THE INVENTION

A variety of toilets, also known as water closets, are known, and typically have a stationary receptacle member for receiving liquid or solid human waste, with an associated water tank. When used as a urinal, the conventional toilet is typically used by sitting or the seat that is provided as part of the toilet, or in the case of males often by standing in front of the toilet receptacle member and discharging directly into the receptacle member. Use of a conventional toilet as a urinal has a number of disadvantages, including the splashing of urine from the toilet receptacle member onto areas surrounding the toilet, especially when used by a male, associated objectionable noises, difficulties in use particularly by smaller individuals e.g. children who cannot reach the toilet receptacle member without using a stool or other means of elevation, and the large volume of water, e.g. up to about five gallons, for each flushing of the toilet. In addition, installation of a toilet requires a significant area in which to accommodate the toilet and its associated water tank as well as installation of the associated plumbing. Moreover, the toilet and its tank are heavy, which must be taken into account during installation.

A number of adjustable urinals have been developed for use in association with a toilet and which may in some instances be intended to be unisexual. For instance, U.S. Pat. No. 4,137,579 of P. S. Soler describes a urine drain which has a housing attached to a flexible tube, the drain part of which is discharged through the side of the toilet receptacle member. The water inlet is activated by a valve.

U.S. Pat. No. 5,153,947 of E. C. Markles discloses a urinal that is rotated about a horizontal axis into the desired position. It is believed that the receptacle is not designed for females, and it is not variable in height. The unit flushes only when the toilet flushes and the amount of water used in flushing is not minimal.

U.S. Pat. No. 5,299,328 of W. Walega discloses a toilet, that includes a urinal disposed adjacent to the stationary receptacle member of the toilet and which is movable between a retracted position recessed into the tank of the toilet receptacle member and a use position. It is believed that the receptacle is not designed for females, and the amount of water used in flushing is not minimal.

U.S. Pat. No. 5,390,374 of S. E. Hubrig, et al. has a receptacle that does not drain until it is pushed up to a height greater than the top of the toilet receptacle member. Receptacle movement would seem to be awkward for children, and the amount of water used in flushing is not minimal or automatic.

U.S. Pat. No. 1,660,260 of Diago discloses a pivot-mounted urinal of restricted movement that returns to a vertical position by gravity.

U.S. Pat. No. 4,982,455 of Carter discloses a urinal with a threaded collar for extension of the urinal bowl and which is restricted to forward movement through an angle of approximately 15°.

A urinal that is more user-friendly, which uses a minimal amount of water and could be automatic in flushing, and which may be used in locations other than adjacent to a toilet would be useful. It would be advantageous if the urinal is unisexual.

SUMMARY OF THE INVENTION

A urinal has now been found that may be used in locations other than adjacent to a toilet, and which may be used by both males and females. The urinal is adjustable in height and convenient to use.

Accordingly, one aspect of the present invention provides a free-standing urinal for use by an adult person or child of either sex, said urinal being comprised of a receptacle member and a tube, said receptacle member being connected by a rigid non-extendible pipe to a pivot and pivotable between a first position and a second position, said first position being variable between a floor and said second position by pivoting of said rigid non-extendible pipe and said second position being a retracted position, said receptacle member remaining in said first position when moved thereto, said receptacle member being usable by said adult person or child for the voiding of waste liquids therein when said receptacle member is in the first position, said receptacle member having a reservoir adapted to retain waste liquid when in any first position between said floor and a position of use by an adult, a tube located within the receptacle member and adapted to be connected to a supply of water to said receptacle member, said tube adapted to provide flushing of the receptacle member with less than one litre of water per minute, said receptacle member being connected to a drain for disposal of said waste liquids and water.

BRIEF DESCRIPTION OF THE DRAWINGS

The present invention will be particularly described with reference to the embodiments shown in the drawings in which.

DETAILED DESCRIPTION OF THE INVENTION

Figure 1:
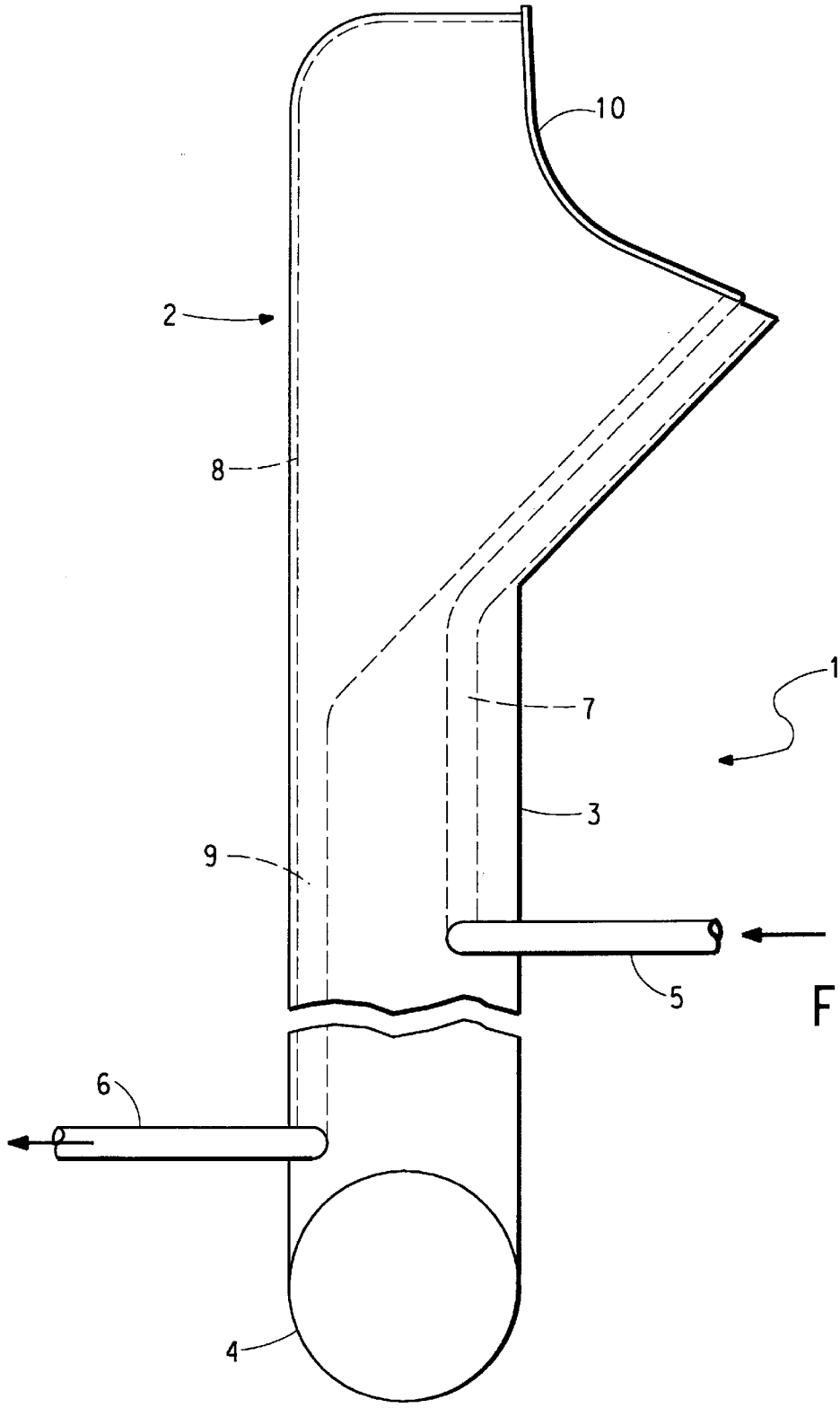
FIG. 1 is a schematic representation of a side view of an adjustable urinal.

FIG. 1 shows an adjustable urinal, generally indicated by 1. Adjustable urinal 1 has a housing 2 connected by urinal pipe 3 to pivot mechanism 4. Pivot mechanism 4 is preferably located at or near floor level. An embodiment of pivot mechanism 4 is shown in more detail in FIG. 5. It is understood that the pivot mechanism could restrict movement of the urinal pipe to a vertical plane or permit some lateral movement. As illustrated herein, the pivot mechanism may be mounted on a floor, or above the floor. Water inlet 5 is connected to urinal pipe 3 at the lower end thereof e.g. by tapping into urinal pipe 3, as is urinal drain 6.

Within urinal pipe 3, water inlet 5 is connected to water pipe 7 which extends up urinal pipe 3 to a location at the bottom of housing 2, as described in more detail below. Water inlet 5 and water pipe 7 could be part of the same pipe. Water pipe 7 is shown as located within urinal pipe 3 and housing 2, but it could be located on the outside of either or both of urinal pipe 3 and housing 2. For instance, water pipe 7 may be located within housing 2 but not within receptacle member 8. In the embodiment shown, urine receptacle member 8 is located within housing 2 and is connected at its lower end with drain pipe 9 that extends down and within urinal pipe 3 and is connected to urinal drain 6. Thus, urinal drain 6 is an extension of drain pipe 9, and in embodiments may be the same entity. Housing 2 and receptacle member 8 could be the same, rather than separate entities as illustrated in this embodiment i.e. housing 2 per se could be omitted. Urinal drain 6 and water inlet 5 should have sufficient flexibility for pivoting of the urinal as described herein, or otherwise adapted for such pivoting.

Housing 2 has lid 10, which is optional. Lid 10 may be utilized in activation of the self-flushing mechanism for the adjustable urinal. In the absence of lid 10, the self-flushing mechanism could be activated on movement of housing 2 about pivot mechanism 4, to provide flushing during use or after use or continuous flushing could be used.

In one embodiment, flushing commences when lid 10 is opened and stops when lid 10 is closed. Thus, flushing of the urinal is continuous when required i.e. when the urinal is in use, to clean the urinal and maintain it in a clean state. As an alternative, flushing may be activated by movement of the receptacle into a use position, whether or not the receptacle has a lid, or be self-flushing for a period of time when the lid is closed. As further alternatives, continuous, one-shot rapid or other flushing techniques could be used. Flushing is maintained at less than one litre/minute, especially less than 600 ml/minute and preferably less than 500 ml/minute. This minimises the amount of water used, especially compared with about 18.9 litres/flush (5 gallons/flush) for a typical toilet. A water meter could be used to limit the flow of water e.g. if the lid is not closed. Flushing could be accomplished by water flowing or sprayed around part or all of receptacle member 8.

The pipe connecting the receptacle to the pivot is a rigid non-extendible pipe, so as to permit easy and fast positioning for use by any person, both adults and children. As discussed herein, the positioning may be as low as the floor, for use by children, or at a height suitable for an adult, and the rigid non-extendible pipe is necessary for such easy and fast positioning. This is also necessary in the embodiments of the invention described herein in which a reservoir extends down the stem. The positioning of the receptacle for use is achieved solely by pivoting about the pivot to which the rigid pipe is attached.

If the non-use position of the receptacle has the non-extendible pipe in a vertical position, then in preferred embodiments of the invention the pipe is capable of being pivoted by at least 90° for use.

Figure 2:
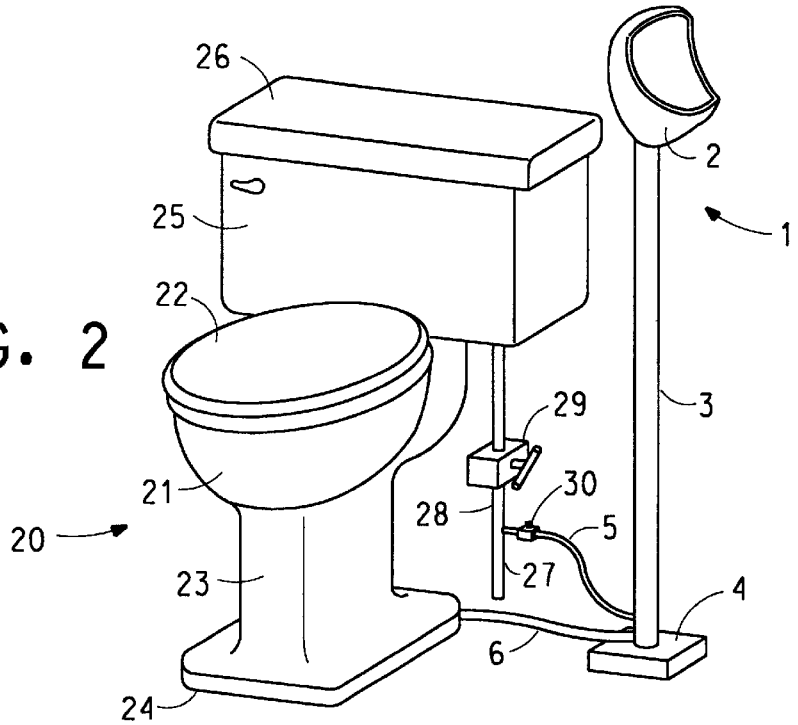
FIG. 2 is a schematic representation of an adjustable urinal adjacent to a toilet.

FIG. 2 shows adjustable urinal 1 located in association with a toilet, generally indicated by 20. Urinal 1 has housing 2, urinal pipe 3, pivot 4 and water inlet 5, as described previously.

Toilet 20 has a toilet receptacle member 21 having lid 22 thereon. Toilet receptacle member 21 is connected to stand 23 which is connected to base 24. Toilet 20 has water tank 25 with tank lid 26, located behind and above toilet receptacle member 21.

Water pipe 27 is shown as connected to water inlet 5 of adjustable urinal 1 as well as to water inlet 28 of water tank 25. Water inlet 5 and water inlet 28 have valves 29 and 30 which may be used to control the flow of water to the adjustable urinal 1 and to water tank 25, or to cut it off completely during installation or for other reasons. It is understood that the location of the valves with respect to the water pipes could be adjusted. Valve 30 (or an equivalent) on water inlet 5 is particularly important in control of flow of water into the urinal.

In the embodiment shown in FIG. 2, drain 6 from adjustable urinal 1 is shown as being fed to base 24 of toilet 20. In this embodiment of the drain, which is shown in more detail in FIG. 4, drain 6 is connected under base 24 into the drain beneath toilet 20, using a spacing plate or shim adapted to receive drain 6 and convey fluid to the drain beneath the toilet. In other embodiments, drain 6 could be tapped into the side of stand 23 of toilet 20. When adjustable urinal 1 is not used in association with toilet 20, drain 6 would be fed to another source of drainage for the urinal or another area for waste disposal.

Figure 3:
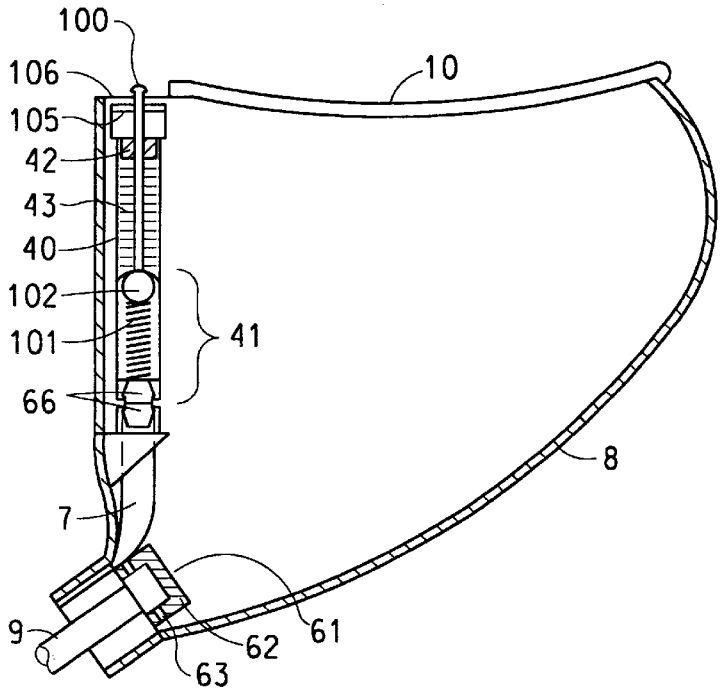
FIG. 3 is a schematic representation of a cross-section of the receptacle of the adjustable urinal and an automatic self-flushing device thereof.

FIG. 3 shows a cross-section of receptacle 8. Water pipe 7 is shown as extending from urinal pipe 3, not shown but located to the underside of receptacle 8 upwards along receptacle 8 to a location at water inlet connector 41.

It is understood that the water pipes referred to herein may be rigid, but the pipes may also be flexible i.e. be more in the form of tubes or hoses. Lid 10 may open in any direction, e.g. in a sideways direction, front to back or slide back. Receptacle member 8 extends from adjacent to lid 10 down to and smoothly interconnecting with drain pipe 9, which as shown in FIG. 1 extends down urinal pipe 3. Urinal pipe 3 and drain pipe 9 could be the same pipe. Likewise, urinal drain 6 and drain pipe 9 could be the same pipe.

Receptacle member 8 is shown as having trap 61 located in the bottom thereof, where receptacle member 8 merges into drain pipe 9. Trap 61 has a solid portion, indicated by 62, having vents 63 therein through which liquid may pass. Trap 61 is intended to prevent the passage of solid material e.g. paper, into drain pipe 9, in which it could cause a blockage. It is also understood that trap 61 could be shaped so that drain pipe 9 extends up into trap 61, to a height above vents 63, thereby forming a liquid trap (not shown). Traps of other shapes e.g. S-shaped traps, may be inserted in drain pipe 9 and/or urinal drain 6, in which case a screen may be inserted in receptacle member 8, adjacent to drain pipe 9, to prevent passage of solid material into drain pipe 9.

FIG. 3 also illustrates an embodiment of a self-flushing device. Using coupling 66, water inlet pipe 7 is connected to flushing tube 40 which houses spring 101 and ball 102, the interior of flushing tube 40 being shaped so that ball 102 prevents water from flowing. Push rod 100 is used to move ball 102 and let water pass through. Push rod 100 extends through a small hole in plug 42. Water exits flushing tube 40 through water vent holes 43. Shield 105 attached to push rod 100 prevents water from exiting out of receptacle 8. In an embodiment, movement of lid 10 depresses push rod 100 by means of knob 106. Another alternative embodiment utilizes forward movement of receptacle 21 to depress push rod 100. A valve could be used to control the flow of water to flushing tube 40. It is understood that flushing tube 40 could be a spray head, spray nozzles or other flushing device. Spray nozzles with holes similar to a paint spray gun may be usable in some locations particularly depending on water purity, and capable of continuous flushing at as little as 2.6 ml/minute i.e. less than a gallon/day. Other spray devices may be used including, devices with holes of adjustable sizes.

Figure 4:
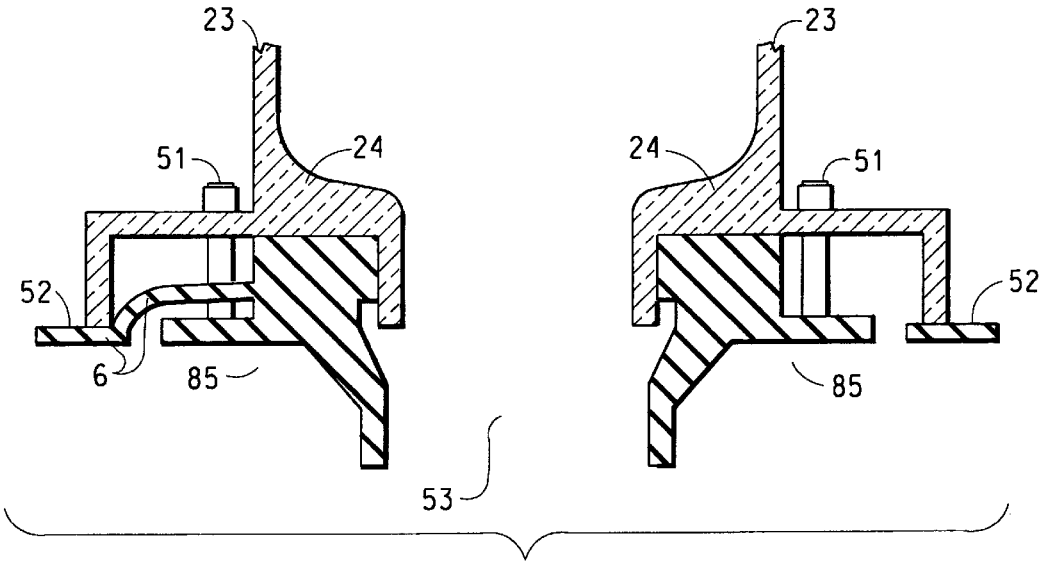
FIG. 4 is a schematic representation of an embodiment of a drain system for discharge of waste from the receptacle member.

FIG. 4 shows a cross-section of urinal drain 6 connected under base 24 of a toilet receptacle member, partially shown by stand 23. In the embodiment of FIG. 4, base 24 is attached to floor 85 by means of nut and bolt combination 51. The standard method of attaching toilet receptacle member to a floor has been modified in the embodiment of FIG. 4 by having urinal drain 6 enter under base 24, using spacing plate or shim 52 that is adapted to receive urinal drain 6 and convey fluid therefrom to toilet drain 53. Toilet drain 53 is a drain for a toilet receptacle member (not shown), to a drain system e.g. the sewer. Urinal drain 6 extends under base 24, through spacing plate 52, so as to effect discharge of urine and flushing water from adjustable urinal 1 into toilet drain 53. In the absence of a toilet receptacle member, it is understood that urinal drain 6 would be connected to some other suitable source for discharge of urine and water from adjustable urinal 1. Urinal drain 6 and its connection to a drain could utilize one or more pipes for discharge of urine or water.

In an embodiment, the drain pipe, urinal drain and water inlet may be directed to the back of the toilet and encased in a flexible tubing that is fastenable to the urinal pipe, toilet or the floor, although each could be attached separately. This would increase aesthetic appeal and also provide additional strength, which might be important for use by children.

Figure 5:
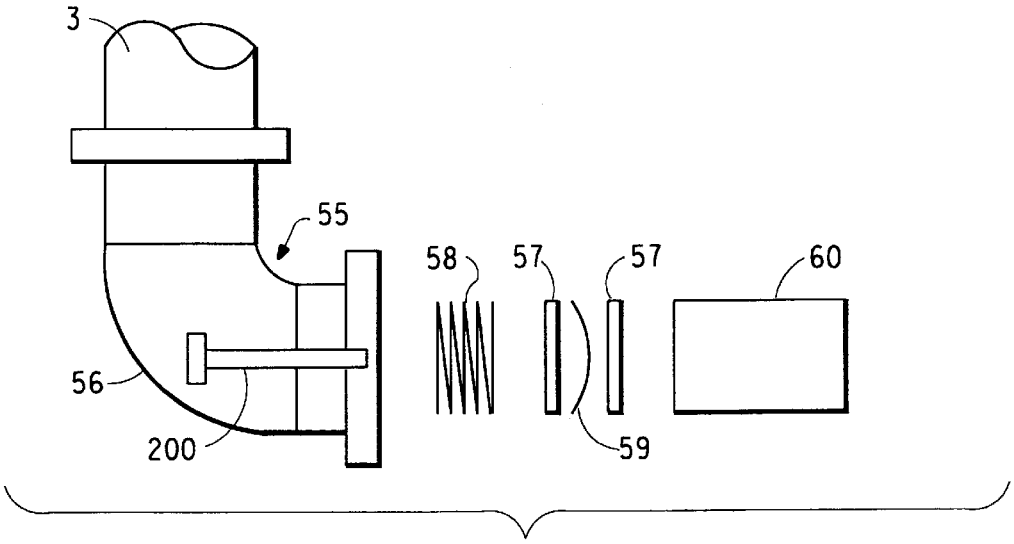
FIG. 5 is a schematic representation, in exploded view, of an embodiment of a pivot mechanism used in the adjustment of the urinal.

FIG. 5 shows an exploded view of an embodiment of pivot mechanism 4 of FIG. 1 for use with the adjustable urinal of the present invention. Urinal pipe 3 is connected to an elbow 55. Elbow 55 is connected in turn with rigid material 56, guide 200, non-compressible spring material 58, curved plate 59, two plates 57 and adapter 60; adapter 60 may be in the form of a threaded nipple, and be a single part or assembled from several parts. It is intended that the combination of parts shown in the exploded view of FIG. 5 would permit urinal pipe 3 to be adjusted to any desired angle, including to floor level and to retain urinal pipe 3 at that position. The combination of the screw thread on adapter 60 with the non-compressible spring material 58 would effect this ability to position adjustable urinal 1 i.e. the urinal pipe 3, in the desired position. Other pivot mechanisms could be used.

The combination of the pivot mechanism, rigid stem and drainage ensures that the receptacle will drain at any height. This makes the urinal usable even by small children who are just starting to toilet train, in addition to older children and adults.

Movement of elbow 55, or parts associated therewith, may be used to open or close a ball valve.

In an alternate embodiment, rigid material 56 extends into adapter 60, or other male threaded fitting, to contact non-compressible spring material 58, plates 57 and plate 59. Plate 59 is preferably curved. Alternatively, plate 59 could be a pair of plates or plates 57, 59 could be placed with non-compressible spring material 58 around the threaded part of the adapter 60 or other appropriate male threaded fitting so that compression occurs on the outside of adapter 60 instead of inside elbow 55. Preferably, the non-compressible spring material 58 would fit adjacent to the threaded part of adapter 60 on an unthreaded part to avoid wear caused by the threads. The non-compressible spring material 58 would be compressed between the elbow and a larger diameter of the adapter 60 with an arrangement of plates 57 and curved plates 59 adjacent to the non-compressible spring material 58. Other embodiments could be used. The guide can be shaped at the end to connect to the opening handle of a ball valve to turn the valve off and on with rotational movement of elbow 55. In another embodiment, a ball valve is screwed onto a nipple, after inserting a washer and a plate into the female end of the ball valve. The other end of the valve is also sealed. A rod connecting the on/off lever of the valve to the stem enables the movement of the stem to open and close the valve.

Figure 6:
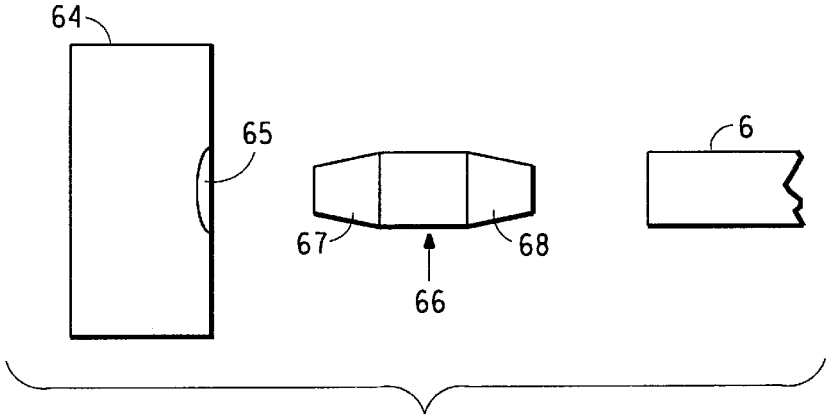
FIG. 6 is a schematic representation, in exploded view, of a tap used to connect the drain pipe to a drain.

FIG. 6 illustrates a tap that could be used to connect urinal drain 6 to drain 64, using a coupling, generally indicated by 66. Coupling 66 has opposed wedge-shaped ends 67 and 68. Coupling 66 is hollow, to allow passage of fluid from urinal drain 6 to drain 64. Coupling 66 is coated with a suitable sealant or sealing ring, not shown, before being pressed into orifice 65 in drain 64. Wedge-shaped end 67 is of a shape and material to enable the end to be pushed into orifice 65 and be retained therein; in practice, end 67 may be pushed into drain 64 to effect a good seal. The sealant provides a seal against the leakage of liquid. Similarly, wedge-shaped end 68 is inserted and sealed into urine drain 6. While FIG. 6 illustrates a tap directly into a drain, 64, it is understood that a wedge shaped flaring on the end of the drain line could be passed through holes in the floor and drain pipe of the toilet or through a wall and drain vent or some other suitable location. A sealing hose would then be pushed over it and the drain line pulled through the holes to complete a tap. It is also to be understood that such tapping techniques could be used to connect a source of water to the urinal. The ends of the ball valve may be sealed and tapped into using this method.

In order to provide a vent to a drain trap e.g. an S-shaped trap, an air line may be tapped into the drain pipe or the urinal drain 6, urinal pipe 3 or drain pipe 9. Such an air line (not illustrated) may be connected to an appropriate location in the drainage system of the building in which the urinal is located. For example, the air line could follow the drain line under the toilet to a location open to the toilet drain, similar to urinal drain 6 but separated from the end of urinal drain 6. Parts of the tapping of the water supply, drainage or venting may be reinforced to prevent removal.

A variety of methods of tapping into water supply lines may be used, including use of holes drilled in the water supply line and the use of tapping mechanism frequently used to attach humidifier systems to water supply lines. It is understood that some methods may not comply with plumbing or other by-laws in some jurisdictions, and thus could not be used.

Figure 7A:
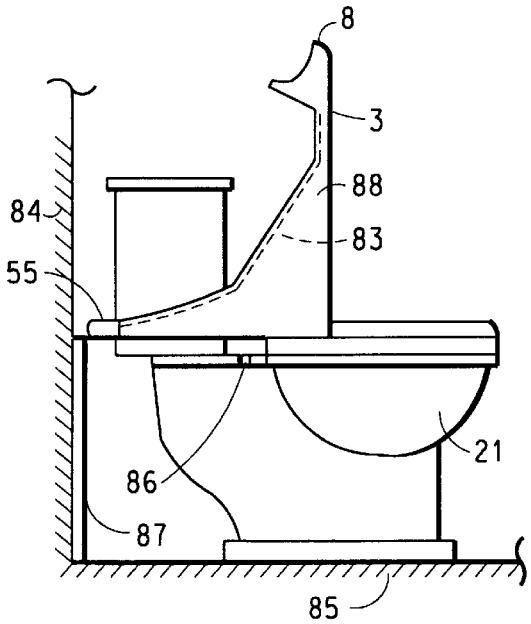
FIGS. 7A and 7B are schematic representations of side and front view of an alternate urinal.
Figure 7B:
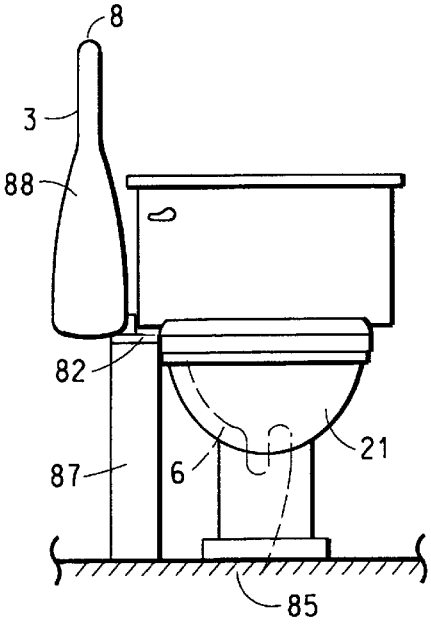

FIGS. 7A and 7B show an embodiment of the present invention as described herein that has the additional feature of being very easy to install. In this embodiment, liquid waste and water drains through a flexible urinal drain 6 that extends along the inside of the toilet receptacle member 21 to the toilet drain 53 (not shown). More than one urinal drain 6 may be used.

Figure 8A:
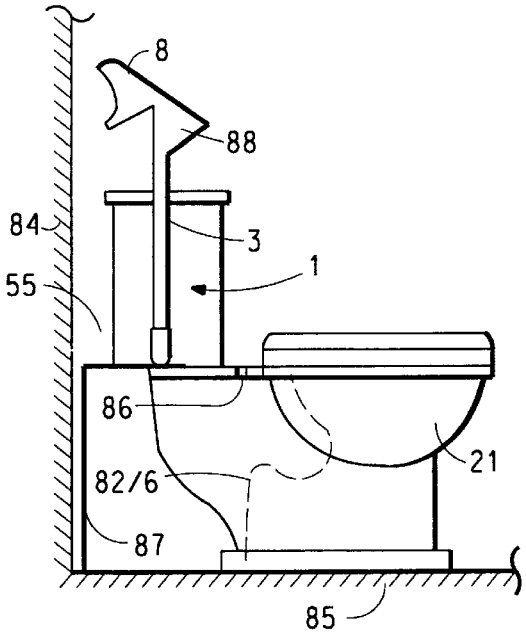
FIGS. 8A and 8B are schematic representations of side and front views of a urinal with a pelican reservoir.
Figure 8B:
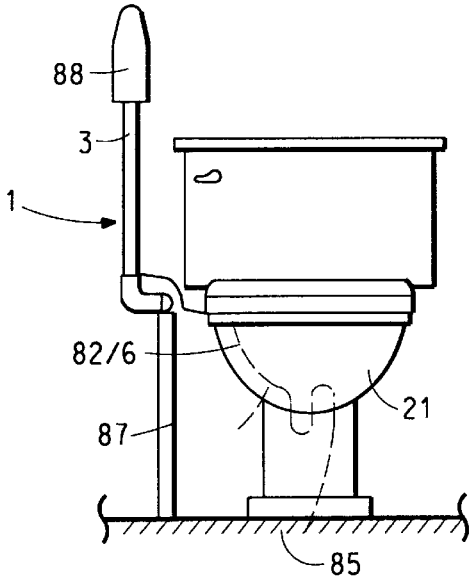
Figure 9A:
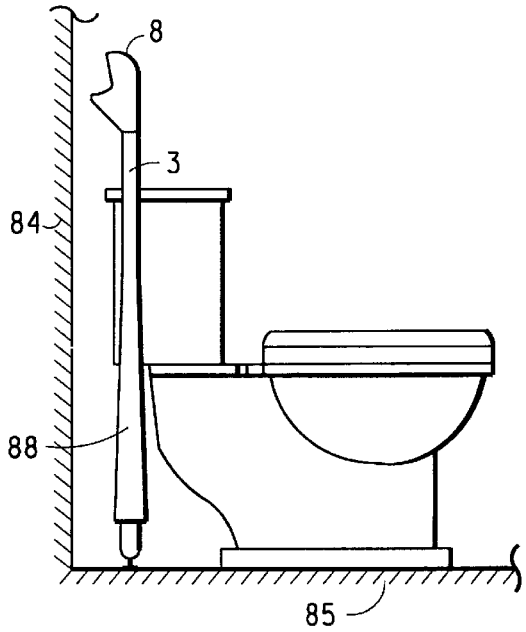
FIGS. 9A and 9B are schematic representations of side and front view of a further urinal.
Figure 9B:
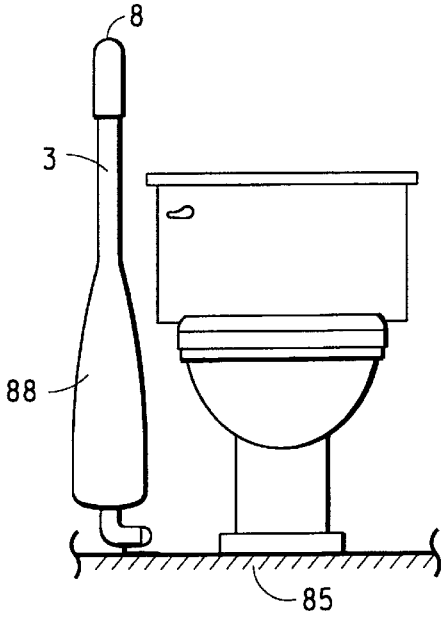

The urinal is mounted on a stand 87 that is secured to the toilet seat bolt holes 86 and/or the floor 85 and/or the wall 84. A reservoir 88 has been added to the urinal to hold the flushing water and the urine drained from the receptacle 8, in particular, for children who are not tall enough to use the receptacle 8 at a height at which it will empty i.e. below the top of the toilet receptacle member 21. It is understood that the urinal receptacle member 21 may be lowered below where it is secured to the toilet. The reservoir 88 may be stem 3 described above, or part thereof, that has been swollen to the appropriate shape demonstrated in FIG. 7A and 7B, and/or could be part of the receptacle. However, a preferred shape is shown in FIGS. 8A and 8B. The latter shape may be referred to as a "pelican" shape, resembling the shape of the pouch on the bird. And her alternate shape is shown in FIGS. 9A and 9B. It will be appreciated that the pelican shape of reservoir 88 could extend all or partly down urinal pipe 3.

When the reservoir 88 (or the liquid therein) rises above the rim of the toilet receptacle member 21, the liquid waste empties through urinal drain 6. The height of the urinal must be such that the liquid waste can drain from the reservoir 88. The reservoir 88 is large enough to hold both the water used in flushing, if need be, and the urine waste. In FIG. 7A and 7B, the top of the elbow 55 is connected to the reservoir 88 and points horizontally, instead of vertically as in FIGS. 1, 8A and 8B.

The receptacle can drain directly into reservoir 88 or through a drain pipe 9 (not shown).

In order to allow air to be released from the reservoir 88 when it is being filled and to bring air into the reservoir 88 when it is emptying, an air vent line 83 is used. Air vent 83 could be connected to air transfer line 82 which extends along the inside of the toilet receptacle member 21, to a toilet drain. Air vent 83 and air transfer line 82 could be the same. Air vent line 83 could be located on the outside of urinal pipe 3 and/or reservoir 88 e.g. in a trough and extend into the reservoir 88 through a hole at the end of the trough. The air vent line 83 could be fastened to urinal pipe 3 and/or reservoir 88 to prevent removal. More than one air transfer line 82 may be used.

This model can use constant flushing as the reservoir is big enough to accept the liquid waste of a child and the water used in flushing. However, if the child forgets to close the lid or push the receptacle back to its resting position, the reservoir could overflow and so a float valve or a water meter should be used. The reservoir could drain at a slower rate than the receptacle, as a result of the reservoir holding a relatively large volume of liquid. Consequently, drainage lines of small diameter would be used, minimizing the height that the toilet would need to be separated from the floor to permit drainage e.g. as little as about 0.125 inches if the drainage line was of that diameter. A plug and appropriate trap combination can be easily installed where required.

For flushing of a urinal that does not utilize a "pelican" reservoir when the receptacle is intended for use at floor level, the rigid pipe would likely need to be Z-shaped, or equivalent, to permit the receptacle and drainage system to be at floor level.

It is understood that the "pelican" reservoir could be used with the other urinal described herein.

The receptacle used on the urinal must be capable of receiving liquid in all positions of use, from heights to be used by adult males and females to heights at or close to floor level for use by children.

It is understood that drainage from the urinal may pass through the pivot described herein, or by-pass the pivot.

In use, a person pulls the housing down to an acceptable height, and lifts (opens) the lid, if present, on the housing. The housing remains at that height. The self-flushing mechanism is activated, usually by the opening of the lid although flushing could be activated by movement of the housing to its use position. The person then urinates in the receptacle member, and returns the housing to its retracted or storage position. The flushing of the receptacle member would normally then cease, although in embodiments described herein flushing could continue, preferably at a lower rate e.g. for hygienic reasons, for instance to flush disinfectants, deodorants or the like.

In the embodiment of FIG. 3, flushing could be activated manually using a push button e.g. knob 106. Such flushing would normally be independent of use of the urinal i.e. activated by the user of the urinal. However, opening of a lid on the receptacle could open the valve and effect continuous flushing. Alternatively, movement of the receptacle to the first position could open the valve and effect continuous flushing or the flushing could be activated for a predetermined period on return of the urinal to the storage position or upon closing the lid.

The adjustable urinal of the present invention is a free-standing urinal for both males and females. It uses a unisexual configured small receptacle which is designed to quietly capture urine without the usual splashing on surrounding areas. The receptacle is attached to a pipe. The pipe is attached to a 90° elbow which in turn is attached to an pivot mechanism that may be attached to the floor, as has been shown in the drawings herein, or to some other suitable location.

The receptacle may be raised or lowered to any height and will remain there during use until the user moves it. Therefore the invention is easily used by toilet-trained people of all heights and ages including children who, when using the conventional toilet to urinate, have required help to reach the receptacle member of the toilet, or in toilet training of children.

In the embodiment that has been illustrated, the lowering of the receptacle is enabled by the rotation of the elbow on the pivot mechanism. The pivot mechanism has a male thread that the female thread of the elbow screws onto. The thread is preferably configured so that as the receptacle member/housing is lowered the elbow is tightened. To make the receptacle member stay at the desired height, a non-compressible spring material is compressed by the advancement of the elbow on the pivot mechanism. The resulting force enables the receptacle member to stay at the desired position. It is understood that other means may be used to make the receptacle member remain at the desired height.

In embodiments, the receptacle may be adapted to move in a lateral motion, to facilitate use in tight or awkward places. The receptacle shape may be varied for the same reasons or, for instance, to be more user friendly for physically challenged persons.

The present invention has been described with reference to a self-flushing mode which is the preferred mode.

The receptacle member is drained using a pipe that extends from the bottom of the receptacle member. As described herein, the pipe may be fed directly to a suitable drain. Alternatively, the pipe may be fed into the toilet, either under the base in the toilet, as described, or by tapping into the stand or base of the toilet or into some other drainage means. In a further embodiment, the urinal of the invention may be integral with a toilet, not merely drained into a toilet drain.

It is understood that the drainage from the receptacle member to the drain may include a trap, as is known, to prevent odours from the drain from passing back up to the receptacle member.

The invention requires simple connections to the drainage system and a fresh water plumbing system and therefore can easily be installed in any room of a building, especially when compared to the installation of a conventional or specially configured toilet or urinal.

Reference has been made herein to provision of a supply of water to the urinal, especially to the tube located within the receptacle. A number of methods of providing the supply of water have been described, but it is to be understood that any convenient source of the supply of water may be used. For instance, the supply of water might be from municipal sources through appropriate connections to the urinal. However, in other circumstances, the supply of water might be provided by use of electrical, mechanical, manual or other pumping devices, including dispensers, use of tanks or other vessels that are elevated with respect to the urinal, or from any other source.

It is also understood that the drain to which the receptacle member is connected could discharge into any convenient system for collection and/or removal of the waste from the urinal. For instance, the collection system could be a municipal or other system for sewage, but it may also be a tank or other vessel, container or pit or the like that might be more commonly used, for example, in cottages, camp sites or boats or the like.

The present invention provides a urinal that may be used by both sexes, as well as by children. It may be located adjacent to a toilet or at another location that has a supply of water for flushing and a drain. It is easy to use.

As it will be appreciated, solid discs of scent may be used with the urinal. Sanitary covers may also be used. The urinal could also be fitted with a bidet.

The urinal may be fabricated using the parts described herein. However, it will be understood by persons skilled in the art that some such parts may be integrally manufactured as a unit e.g. by injection or blow moulding. For example, the receptacle reservoir, water pipe, drain pipe and stem may be manufactured as an integral unit. A variety of materials may be used to fabricate the urinal or parts thereof, including fibreglass, polyvinyl chloride or polyethylene.

The present invention is illustrated by the following examples.

EXAMPLE I

A water system of FIG. 3 was tested at water pressures of between about 145 and 160 psi, using the embodiment in which constant flushing was achieved on movement of the push rod.

The system was operated for 25 000 cycles without visible signs of any failure.

Tests also showed that spray holes in tubing as disclosed herein could be operated using a volume of water from a municipal water supply system equivalent to about 18 years of usage, without evidence of build-up of calcium or magnesium carbonates from the water supply.

EXAMPLE II

A pivot mechanism utilizing a bolt that extends through the elbow and through a guide having plates; and polyurethane non-compressible spring material, with the last plate contacting a threaded nipple, was tested through 25 000 cycles without visible signs of failure.

EXAMPLE III

A total of 126 taps of a type disclosed herein were connected to a fresh-water plumbing line at a pressure of 150 psi. There were no signs of failure i.e. no signs of leakage.

EXAMPLE IV

An embodiment of a urinal as described herein was subjected to normal use by one person in a residential bathroom for a period of approximately six months. The urinal was found to operate successfully, using an average of less than 400 ml of water per flush. Normal use was less than one minute. In contrast, a conventional toilet will use about 18.9 litres of water per flush, depending on the size of the tank on the toilet.

EXAMPLE V

An embodiment of a urinal having a "pelican" reservoir was mounted on a pivot located at 16" above the floor, but capable of being pivoted to floor level. The pelican reservoir could hold up to 600 ml of liquid at any angle of use including at floor level.

The embodiment was tested and found to provide acceptable operation.

Similar tests were made with a pelican reservoir capable of holding one litre of liquid, and the same results were obtained.

I claim:

1. A free-standing urinal for use by an adult person or child of either sex, said urinal being comprised of a receptacle member and a tube, said receptacle member being connected by a rigid non-extendible pipe to a pivot and pivotable between a first position and a second position, said first position being variable between a floor and said second position by pivoting of said rigid non-extendible pipe and said second position being a retracted position, said receptacle member remaining in said first position when moved thereto, said receptacle member being usable by said adult person or child for the voiding of waste liquids therein when said receptacle member is in the first position, said receptacle member having a reservoir adapted to retain waste liquid when in any first position between said floor and a position of use by an adult, a tube located within the receptacle member and adapted to be connected to a supply of water to said receptacle member, said tube adapted to provide flushing of the receptacle member with less than one litre of water per minute, said receptacle member being connected to a drain for disposal of said waste liquids and water.

2. The urinal of claim 1 in which the pivot is mounted on the floor.

3. The urinal of claim 1 in which the pivot is mounted above the floor.

4. The urinal of claim 1 in which the receptacle member has a lid, and opening of the lid activates the flushing of the receptacle member.

5. The urinal of claim 1 in which the urinal is used in association with a toilet.

6. The urinal of claim 5 in which the urinal is drained into part of a toilet, said part of the toilet being below the toilet receptacle member thereof.

7. The urinal of claim 1 in which the urinal is located away from a toilet.

8. The urinal of claim 1 in which the urinal drains directly into a drain.

9. The urinal of claim 8 in which the receptacle member is connected to the drain by tapping into the drain.

10. The urinal of claim 1 in which the receptacle member is located within a housing.

11. The urinal of claim 1 in which the supply of water is provided to the urinal by tapping a source of water.

12. The urinal of claim 1 in which movement of the receptacle member to the first position activates the flushing of the receptacle member.

13. The urinal of claim 1 in which the receptacle member is continuously flushed with water when the receptacle member is in the first position.

14. The urinal of claim 1 in which the receptacle member is adapted to flush after use.

15. The urinal of claim 1 in which the reservoir is a pelican reservoir.

16. The urinal of claim 1 in which the receptacle member is flushed with less than 600 ml of water/minute.

17. The urinal of claim 2 in which the receptacle member is flushed with less than 600 ml of water/minute.

18. The urinal of claim 3 in which the receptacle member is flushed with less than 600 ml of water/minute.

* * * * *